US007531284B2

(12) United States Patent
Herbert et al.

(10) Patent No.: US 7,531,284 B2
(45) Date of Patent: May 12, 2009

(54) MULTI-LAYER PHOTORECEPTOR

(75) Inventors: William G. Herbert, Williamson, NY (US); Andronique Ioannidis, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 11/004,150

(22) Filed: Dec. 3, 2004

(65) Prior Publication Data

US 2006/0121377 A1 Jun. 8, 2006

(51) Int. Cl.
*G03G 5/14* (2006.01)

(52) U.S. Cl. ..... 430/131; 430/65

(58) Field of Classification Search ..... 430/65, 430/60, 69, 64, 127, 131, 133
See application file for complete search history.

(56) References Cited

U.S. PATENT DOCUMENTS 3,148,057 A * 9/1964 Raether ..... 430/49.5
3,615,413 A * 10/1971 Fisher et al. ..... 430/86
3,635,705 A * 1/1972 Ciuffini ..... 430/58.1
3,791,826 A * 2/1974 Cherry et al. ..... 430/65
4,265,990 A 5/1981 Stolka et al.
4,298,697 A 11/1981 Baczek et al.
4,338,390 A 7/1982 Lu
4,369,242 A * 1/1983 Arimilli et al. ..... 430/59.1
4,464,450 A 8/1984 Teuscher
4,560,635 A 12/1985 Hoffend et al.
4,800,144 A * 1/1989 Ueda et al. ..... 430/58.05
4,921,769 A 5/1990 Yuh et al.
4,921,773 A 5/1990 Melnyk et al.
4,933,255 A * 6/1990 Hata et al. ..... 430/131
5,104,756 A * 4/1992 Fukuda et al. ..... 430/58.1
5,284,727 A * 2/1994 Itakura et al. ..... 430/58.05
5,723,241 A * 3/1998 Ueda ..... 430/165

OTHER PUBLICATIONS

Diamond, A.S., ed., *Handbook of Imaging Materials*, Marcel Dekker, Inc., NY (1991), pp. 395-396.*

* cited by examiner

*Primary Examiner*—Janis L Dote
(74) *Attorney, Agent, or Firm*—Eugene O. Palazzo; Fay Sharpe LLP

(57) ABSTRACT

A photoreceptor and method of forming the same is disclosed. A photoreceptor includes a substrate, an undercoat layer, and an imaging layer. The undercoat layer comprises a single, non-porous anodized aluminum layer that has an impedance of less than about 50 Kohm. The single, non-porous anodized aluminum layer may be used as the undercoat layer alone, or may be part of a multi-layered undercoat layer system that includes additional layers of other undercoat materials. The use of the non-porous anodized aluminum layer provides the photoreceptor with an extended effective life.

4 Claims, 1 Drawing Sheet

MULTI-LAYER PHOTORECEPTOR

BACKGROUND

The present disclosure relates, in various exemplary embodiments, generally to photoreceptors or imaging members for electrophotographic or xerographic processes. More particularly, the present disclosure relates to a multi-layered photoreceptor or imaging member that includes an undercoat layer adjacent to a substrate, where the undercoat layer includes at least a non-porous anodized aluminum barrier overlay coating.

In an electrophotographic application such as xerography, a charge retentive surface (i.e., photoconductor, photoreceptor, or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner." Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface.

The aforementioned process is known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

Electrophotographic imaging members are commonly multilayered photoreceptors that include a substrate support, an optional electrically conductive layer, an optional charge blocking layer, an optional adhesive layer, a charge generating layer, a charge transport layer, and an optional protective or overcoating layer(s). The photoreceptor or imaging members can take several forms, including flexible belts, rigid drums, and the like.

In multi-layered photoreceptors or imaging members, an undercoat layer is often deposited between the substrate and a photosensitive or imaging layer(s) to enhance the physical and/or electrical properties of the photoreceptor. For example, an undercoat layer may be used to provide dielectric strength or conductivity to the photoreceptor, provide mechanical adhesion strength between the substrate and the photosensitive layer(s), and to improve cyclic stability of the photoreceptor. An undercoat layer may also be utilized to provide charge blocking capabilities and, for example, prevent holes from being injected from the conductive layer to the opposite photoconductive layer(s).

Additionally, an undercoat layer may also be utilized to prevent light-scattering, plywood defects. The use of coherent illumination sources in conjunction with multilayered photoreceptors results in a print quality defect known as the "plywood effect" or the "interference fringe effect." This print defect consists of a series of dark and light interference patterns that occur when the coherent light is reflected from the interfaces that pervade multilayered photoreceptors. The plywood effect in organic photoreceptors generally results from the reflection from the air/charge transport layer interface, i.e., the top surface, and the reflection from the undercoat layer or charge blocking layer/substrate interface, i.e., the substrate surface. The effect can be eliminated if the strong charge transport layer surface reflection, or the strong substrate surface reflection, is reduced or suppressed.

Typically, the undercoat layer in many multilayered photoreceptors is a resin layer. The resin layer is generally formed of, for example, a mixture of acetyl acetone zirconium tributoxides, and gamma amino propyltriethoxysilane, casein, polyvinyl alcohol, nitro cellulose, ethylene acrylic acid copolymer, polyamide (nylon 6, nylon 615, nylon 610, copolymerized nylon, alcoxy mentholated nylon, and the like), polyurethane, gelatin, and like materials.

The undercoat resin layers, however, often exhibit poor environmental cyclic stability due to the fact that the volume resistivity of a resin greatly depends on the ionic conductivity and is strongly affected by temperature and humidity conditions. Additionally, conventional undercoat layers that employ light-scattering particles have a limited range of suitable materials that may be used as the light-scattering particles. Many polymeric materials have the particle size, density and dispersion stability in the proper range, but have refractive index values that are too close to the binder resin used in the undercoat layer. Light-scattering particles having a refractive index similar to a binder refractive index may produce light scattering insufficient to eliminate the plywood effect in the resulting prints.

It is thus desirable to provide material, suitable for use as an undercoat layer in a photoreceptor in an imaging device, which exhibits beneficial properties and contributes to the performance of the imaging member. It is further desirable to provide an undercoat layer for a photoreceptor with properties that will contribute to extending the life of the photoreceptor. Among other things, it is desirable to provide an undercoat layer with improved corrosion resistance, enhanced hardness, and more uniform dielectric characteristics to increase the life of the photoreceptor.

BRIEF DESCRIPTION

The present disclosure provides, in various exemplary embodiments, in one aspect, a photoreceptor comprising a substrate, at least one imaging layer, and an undercoat layer disposed between the substrate and the imaging layer. The undercoat layer comprises a non-porous layer of anodized aluminum and has a specific impedance of about 50 Kohm or less.

In another aspect, the present disclosure provides a photoreceptor comprising a substrate, a non-porous barrier layer disposed on the substrate, and at least one imaging layer. The non-porous barrier layer comprises anodized aluminum, and exhibits a specific impedance of from about 20 to about 50 Kohm, and functions as an undercoat layer.

In still another aspect, the present disclosure provides a method of forming a photoreceptor, the method comprising providing a substrate, forming at least one undercoat layer over the substrate, and forming an imaging layer over the undercoat layer. The undercoat layer comprises a non-porous anodized aluminum material that is formed by anodizing aluminum or an aluminum alloy in an electrolyte solution comprising an organic acid in an amount of about 0.25 to about 5 percent (w/v), at a temperature of about 2 to about 20° C., under a voltage of about 5 to about 24 volts. The non-porous anodized aluminum layer produced by this process exhibits an impedance of about 50 Kohm or less.

In yet another aspect, the present disclosure provides a photoreceptor comprising a substrate, an undercoat layer adjacent the substrate, and at least one imaging layer, wherein the undercoat layer comprises a single, non-porous layer of anodized aluminum, and one or more layers, comprising an undercoat material, adjacent to the non-porous anodized aluminum layer.

These and other non-limiting aspects and/or objects of the exemplary embodiments disclosed herein are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
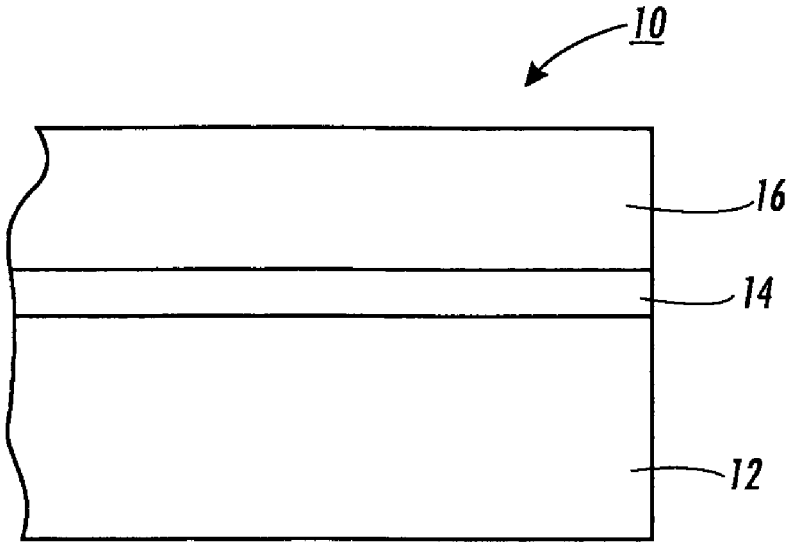
FIG. 1 is a schematic of a cross section of a first embodiment of a photoreceptor according to the present disclosure.

The present disclosure relates, in various exemplary embodiments, to photoreceptors suitable for use in electrophotographic or xerographic processes. The photoreceptor includes at least one substrate, an undercoat layer, and an imaging layer. The undercoat layer comprises a single, non-porous anodized aluminum layer that has an impedance of less than about 50 Kohm. The single, non-porous anodized aluminum layer may be used as the undercoat layer alone, or may be part of a multi-layered undercoat layer system that includes additional layers of other undercoat materials. The use of the non-porous anodized aluminum layer provides the photoreceptor with an extended effective life.

A more complete understanding of the processes, devices and apparatuses disclosed herein can be obtained by reference to the accompanying drawings. These figures are merely schematic representations based on convenience and the ease of demonstrating one or more of the exemplary embodiments, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, a first embodiment of a photoreceptor in accordance with the present disclosure is shown. Photoreceptor 10 includes a substrate 12, an undercoat layer 14 adjacent to the substrate, and an imaging layer 16 adjacent the undercoat layer. The undercoat layer 14 is a single layer, non-porous anodized aluminum barrier layer as described herein.

Figure 2:
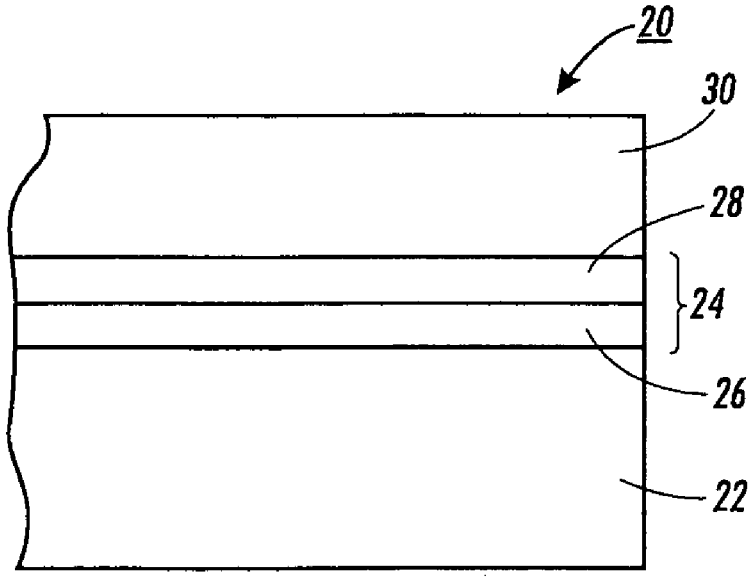
FIG. 2 is a schematic of a cross section of a second embodiment of a photoreceptor according to the present disclosure.

With reference to FIG. 2, a second embodiment of a photoreceptor in accordance with the present disclosure is illustrated. Photoreceptor 20 includes a substrate 22, an undercoat layer 24, and an imaging layer 30. The undercoat layer 24 is a multilayered undercoat layer or undercoat system that includes a single layer, non-porous anodized aluminum barrier layer 26 as described herein, and an additional undercoat layer 28.

The substrate may comprise any material suitable as a substrate in photoreceptors, including a layer of electrically non-conductive material or a layer of electrically conductive material, such as an inorganic or organic composition. The substrate may be flexible, seamless or rigid and may have any number of different configurations including, for example, a plate, a sheet, a scroll, an endless flexible belt, a web, a cylinder, a drum, and the like. The substrate can be opaque or substantially transparent and may comprise any of numerous suitable materials having given required mechanical properties.

In one embodiment, the substrate is in the form of a seamless flexible belt. The back of the substrate, particularly when the substrate is a flexible organic polymeric material, may optionally be coated with a conventional anti-curl layer.

Various resins may be used as electrically non-conducting materials, to form the substrate including, but not limited to, polyesters, polycarbonates, polyamides, polyurethanes, and the like. An example of a material suitable for use in the substrate includes a commercially available biaxially oriented polyester known as MYLAR®, available from E.I. DuPont deNemours and Company, MELINEX®, available from Dupont Tejin Films U.S., or HOSTAPHAN®, registered to Hoechst A.G., and available from Mitsubishi Polymer Film GmbH. Other materials suitable for use in a substrate include polymeric materials such as TEDLAR®, which is a polyvinyl fluoride available from E.I. DuPont deNemours and Company, polyethylene and polypropylene available as MARLEX® from Phillips Petroleum Company, RYTON®, which is a polyphenyline sulfide available from Chevron Phillips Petroleum Company, and polyimides available as KAPTON® from E.I. DuPont deNemours and Company.

When a non-conductive material is employed, it is necessary to provide an electrically conductive ground plane over such non-conductive material. The ground plane acts as the conductive layer. When an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof.

The ground plane can be applied by any suitable coating technique. Examples of suitable coating techniques include, but are not limited to, solution coating, vapor deposition, and sputtering.

The ground plane may have any thickness suitable to provide the optical transparency and flexibility desired for the electro photoconductive member. In embodiments, the thickness of the conductive ground plane for a flexible photoresponsive imaging device is in the range of about 20 angstroms to about 750 angstroms. In further embodiments, for an optimum combination of electrical conductivity, flexibility, and light transmission, the thickness of the conductive ground plane is from about 50 angstroms to about 200 angstroms. In other embodiments, the ground plane may be opaque.

If the substrate is formed from a conductive material, any suitable conductive material may be used. Suitable conductive materials include, but are not limited to, metal flakes, powders or fibers, such as aluminum, titanium, nickel, chromium, brass, gold, stainless steel, carbon black, graphite, or the like, a binder resin including metal oxides, sulfides, silicides, quaternary ammonium compositions, conductive polymers such as polyacetylene or its pyrolysis and molecular doped products, charge transfer complexes, and polyphenyl silane and molecular doped products from polyphenyl silane. The photoreceptor may also be coated on a rigid, opaque, conducting substrate, such as an aluminum drum. In other embodiments, the substrate may be a conducting plastic drum.

The thickness of the substrate is not limited and may be varied depending on the desired mechanical properties and/or economic considerations. In embodiments, the substrate has a thickness in a range of from about 65 micrometers to about 150 micrometers. In further embodiments, for optimum flexibility and minimum induced surface bending stress when cycled around small-diameter rollers, the substrate may have a thickness of from about 75 micrometers to about 125 micrometers. The thickness for a flexible belt can be substantial, e.g., over 200 micrometers, or have a minimal thickness, for example, less than 50 micrometers, provided there are no adverse effects on the final photoconductive device. Where a drum is used, the thickness should be sufficient to provide the necessary rigidity, usually in the range of about 1 to about 6 mm.

Generally, the surface of the substrate to which a layer is to be applied is cleaned to promote greater adhesion of such a layer. Suitable methods for cleaning the surface of the substrate include exposing the surface of the substrate layer to a plasma discharge, ion bombardment, and the like. Other methods, such as solvent cleaning, may also be used.

In the exemplary embodiments of the present disclosure, the photoreceptor also includes an undercoat layer disposed over the substrate. An undercoat layer in accordance with the present disclosure includes at least a non-porous, barrier layer of anodized aluminum. As used herein, non-porous means that the barrier layer is substantially free of any pores over its entire length and thickness. Further, the anodized aluminum undercoat layer is a single, non-porous layer.

The non-porous anodized aluminum layer, which is suitable as the undercoat layer in a photoreceptor, may be formed from pure aluminum or aluminum alloys. Thus, as used herein with respect to the anodized aluminum layer, aluminum includes both pure aluminum and aluminum alloys. If an aluminum alloy is used, the type and number of alloy metals are not limited in any manner. Suitable alloy metals include magnesium, silicon, manganese, copper, zinc and the like. Suitable types of aluminum alloys include but are not limited to aluminum alloys designated as 1050, 6063, A40S, and the like which are known in the art.

The non-porous anodized aluminum barrier layer, in embodiments, has an impedance of about 50 Kohm or less. In other embodiments, the non-porous anodized aluminum barrier layer has an impedance of from about 20 to about 50 Kohm.

The thickness of the barrier layer is, in embodiments, from about 10 to about 50 angstroms. In other embodiments, the thickness of the barrier layer is from about 15 to about 40 angstroms. In still further embodiments, the thickness of the barrier layer is from about 20 to about 30 angstroms. Without being bound to any particular theory, the thin undercoat layer is believed to provide the barrier layer with a stable residual voltage and good cyclic stability.

The non-porous barrier layer is formed by any suitable process that will form a non-porous barrier layer over the substrate. In embodiments, an aluminum material is disposed on the substrate and subjected to anodization. The substrate with the aluminum layer adjacent thereto is placed in an electrolyte bath comprising an organic acid in an amount of 0.25 to about 0.5 percent (w/v). Non-limiting examples of suitable organic acids include oxalic acid, citric acid and the like. The substrate with the aluminum layer is made the anode by connecting the substrate to the positive terminal of a DC power supply. The cathode, which is generally any electronic conductor that is inert in the anodizing bath, such as a plate or rod of carbon, lead, nickel, or stainless steel, is connected to the negative terminal of the supply. Electricity is passed through both electrodes in the electrolytic solution and electrolysis is carried out by either a constant current method or a constant voltage method. The anodizing voltage, in embodiments, is in the range of from about 5 to about 24 volts. The electrolyte solution has a temperature of from about 2 to about 20° C. Under the above conditions, a single, non-porous anodized barrier layer may be obtained.

The single layer, non-porous anodized aluminum barrier layer may be used alone as the undercoat layer, such as shown in FIG. 1. Since it is a single, solid, non-porous layer, this barrier layer does not require sealing, a necessary step in most anodizing processes.

Alternatively, the single layer, non-porous anodized aluminum barrier layer may be used as part of a multi-layered undercoat layer system. A multi-layered undercoat layer system is shown, for example, in FIG. 2. When used in an undercoat layer system, the non-porous anodized aluminum barrier layer, in embodiments, is adjacent the substrate and includes one or more additional undercoat layers adjacent thereto. The additional undercoat layers may be used to provide additional mechanical or electrical properties to the photoreceptor. The material used for the additional undercoat layers and the undercoat layer system is not limited in any manner and may comprise any material suitable as an undercoat layer in a photoreceptor.

The imaging layer refers to a layer or layers containing charge generating material, charge transport material, or both the charge generating material and the charge transport material.

Any material suitable for use as a charge generating material may be used in the present photoreceptor. This includes an n-type or p-type charge generating materials.

The phrase "n-type" refers to materials which predominately transport electrons. Typical n-type materials include dibromoanthanthrone, benzimidazole perylene, zinc oxide, titanium dioxide, azo compounds such as chlorodiane Blue and bisazo pigments, substituted 2,4-dibromotriazines, polynuclear aromatic quinones, zinc sulfide, and the like.

The phrase "p-type" refers to materials which transport holes. Typical p-type organic pigments include, for example, metal-free phthalocyanine, titanyl phthalocyanine, gallium phthalocyanine, hydroxy gallium phthalocyanine, chlorogallium phthalocyanine, copper phthalocyanine, and the like.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent can be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges, for example, from about 70% to about 98% by weight, based on the weight of the composition.

The amount of the charge generating material in the composition ranges, for example, from about 0.5% to about 30% by weight, based on the weight of the composition including a solvent. The amount of photoconductive particles (i.e, the charge generating material) dispersed in a dried photoconductive coating varies to some extent with the specific photoconductive pigment particles selected. For example, when phthalocyanine organic pigments such as titanyl phthalocyanine and metal-free phthajocyanine are utilized, satisfactory results are achieved when the dried photoconductive coating comprises between about 30 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

In a charge generating layer, the weight ratio of the charge generating material ("CGM") to the binder ranges from about 30 (CGM):70 (binder) to about 70 (CGM):30 (binder), including from about 40 (CGM):40 (binder) to about 50 (CGM):50 (binder).

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present exemplary embodiment are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, reference U.S. Pat. No. 4,921,769. Other hole transporting materials include arylamines described in U.S. Pat. No. 4,265,990, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules can be selected, reference for example U.S. Pat. Nos. 4,921,773 and 4,464,450, incorporated herein in their entireties.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

In a charge transport layer, the weight ratio of the charge transport material ("CTM") to the binder ranges from about 30 (CTM):70 (binder) to about 70 (CTM):30 (binder), including from about 40 (CGM):60 (binder) to about 60 (CGM):40 (binder).

Any suitable technique may be utilized to apply the charge transport layer and the charge generating layer over the undercoat layer. Typical coating techniques include dip coating, roll coating, spray coating, rotary atomizers, and the like. The coating techniques may use a wide concentration of solids. Preferably, the solids content is between about 2 percent by weight and 30 percent by weight based on the total weight of the dispersion. The expression "solids" refers to the photoconductive pigment particles and binder components of the charge generating coating dispersion and to the charge transport particles and binder components of the charge transport coating dispersion. These solids concentrations are useful in dip coating, roll coating, spray coating, and the like. Generally, a more concentrated coating dispersion is preferred for roll coating. Drying of the deposited coating may be effected by any suitable conventional technique such as oven drying, infra-red radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to about 200:1 and in some instances as great as 400:1.

Additionally, several further layers, such as an anti-curl layer, an adhesive layer, an overcoat layer, etc., can also be optionally included in the multi-layer photoreceptor disclosed herein.

The materials and procedures described herein can be used to fabricate a single imaging layer type photoreceptor containing a binder, a charge generating material, and a charge transport material. For example, the solids content in the dispersion for the single imaging layer may range from about 2% to about 30% by weight, based on the weight of the dispersion.

Where the imaging layer is a single layer combining the functions of the charge generating layer and the charge transport layer, illustrative amounts of the components contained therein are as follows: charge generating material (about 5% to about 40% by weight), charge transport material (about 20% to about 60% by weight), and binder (the balance of the imaging layer).

In embodiments, photoreceptors according to the present exemplary embodiment may include other layers as are suitable for use in a photoreceptor. For example, the photoreceptor may include an overcoating layer or layers positioned over the charge generation layer or over the charge transport layer.

The photoreceptor or imaging member may be employed in any suitable process such as, for example, copying, duplicating, printing, faxing, and the like. Typically, an imaging process may comprise forming a uniform charge on the imaging member, exposing the imaging member to activating radiation in image configuration to form an electrostatic latent image, developing the latent image with electrostatically attractable marking material to form a marking material image, and transferring the marking material image to a suitable substrate. If desired, the transferred marking material image may be fixed to the substrate or transferred to a second substrate.

Electrostatically attractable marking materials are well known and comprise, for example, a thermoplastic resin, a colorant, such as a pigment, a charge additive, and surface additives. Typical marking materials are disclosed in U.S. Pat. Nos. 4,560,635; 4,298,697 and 4,338,390, the entire disclosures thereof being incorporated herein by reference.

Activating radiation may be from any suitable device such as an incandescent light, image bar, laser, and the like. The polarity of the electrostatic latent image on the imaging member may be positive or negative. The photogenerating pigments primarily function to absorb the incident radiation and generate electrons and holes. In a negatively charged imaging member, holes are transported to the imaging surface to neutralize negative charge and electrons are transported to the substrate to permit photodischarge. In a positively charged imaging member, electrons are transported to the imaging surface where they neutralize the positive charges and holes are transported to the substrate to enable photodischarge. By selecting the appropriate amounts of hole and electron transport molecules, a bipolar transport can be achieved, that is, the imaging member can be uniformly charged negatively or positively and the member can thereafter be photodischarged.

The following examples describe exemplary embodiments of the present disclosure. These examples are merely illustrative, and in no way limit the present development to the specific materials, conditions or process parameters set forth therein. All parts and percentages are by volume unless otherwise indicated.

EXAMPLES

A photoreceptor was made that included non-porous anodized aluminum barrier layers as the undercoat layer. The barrier layer was formed by anodizing aluminum in an electrolyte solution of citric acid in a concentration of 1 percent (w/v) in water. The temperature of the electrolyte solution was 15° C. The anodizing voltage ranged between 12 and 24 volts.

Various properties and characteristics of the undercoat layer and photoreceptor were then tested. The photoreceptor exhibited a stable residual voltage. Specifically, the residual voltage was consistent and under 100 volts. Additionally, the photoreceptor exhibited excellent cyclic stability in that no cycle up or cycle down was observed. The photoreceptor further exhibited an effective life of more than 50 percent of the effective life of a photoreceptor that did not employ a non-porous anodized aluminum barrier layer as an undercoat layer.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A method of forming a photoreceptor, the process comprising:

providing a substrate, the substrate being electrically conductive or comprising an electrically conductive layer;

forming an undercoat layer on said substrate, said undercoat layer consisting of a single non-porous layer of anodized aluminum, wherein said non-porous anodized aluminum layer is formed by anodizing aluminum in an electrolyte solution comprising citric acid in an amount of 1% (w/v), at a temperature of 15° C., under a voltage of 12 to 24 volts; and forming an imaging member over the undercoat layer, wherein said non-porous anodized aluminum layer exhibits an impedance of about 50 Kohm or less and has a thickness of about 10 to about 50 angstroms; and wherein the photoreceptor exhibits a residual voltage of less than 100 V.

2. The method according to claim 1, wherein the non-porous anodized aluminum layer has a thickness of about 15 to about 40 angstroms.

3. The method according to claim 1, wherein the non-porous anodized aluminum layer has a thickness of from about 20 to about 30 angstroms.

4. The method according to claim 1, wherein the impedance of the non-porous anodized aluminum layer is from about 20 Kohm to about 50 Kohm.

* * * * *